United States Patent [19]

Krenzer

[11] Patent Number: 4,557,689

[45] Date of Patent: Dec. 10, 1985

[54] TEXTURING MACHINE

[75] Inventor: Eberhard Krenzer, Ennepetal-Rüggeberg, Fed. Rep. of Germany

[73] Assignee: Barmag Barmer Maschinenfabrik Ag, Remscheid-Lennep, Fed. Rep. of Germany

[21] Appl. No.: 227,911

[22] Filed: Jan. 23, 1981

[30] Foreign Application Priority Data

Jan. 26, 1980 [DE] Fed. Rep. of Germany ... 8002060[U]
Apr. 17, 1980 [DE] Fed. Rep. of Germany ..... 3014748

[51] Int. Cl.[4] ..... D02G 1/16; D02G 1/20; F27B 9/28

[52] U.S. Cl. ..... 432/59; 28/271; 28/281

[58] Field of Search ..... 28/246, 271, 281; 57/350; 219/288, 290; 432/59

[56] References Cited

U.S. PATENT DOCUMENTS

| | | | |
|---|---|---|---|
| 2,456,384 | 12/1948 | Conaway | 28/246 |
| 3,206,922 | 9/1965 | Nagahara et al. | 28/281 X |
| 3,477,218 | 11/1969 | Hawtin et al. | 28/281 X |
| 3,641,249 | 2/1972 | Higgins | 219/390 X |
| 4,001,548 | 1/1977 | Bauer | 219/388 |
| 4,297,837 | 11/1981 | Bauer et al. | 57/350 |
| 4,338,776 | 7/1982 | Krenzer | 57/350 X |

FOREIGN PATENT DOCUMENTS

| | | | |
|---|---|---|---|
| 2333769 | 1/1975 | Fed. Rep. of Germany | 432/59 |
| 614048 | 12/1960 | Italy | 28/246 |
| 46-40843 | 12/1971 | Japan | 432/59 |
| 2009263 | 6/1979 | United Kingdom | 57/350 |

*Primary Examiner*—Robert R. Mackey
*Attorney, Agent, or Firm*—John H. Shurtleff

[57] ABSTRACT

In an air jet texturing machine or the like for bulking a multifilament yarn with means to conduct the bulked yarn through a heating tube under relatively low tension at high speed, said tube having a nominal inner diameter which is more than 10 times the diameter of the bulked yarn and a length of more than 1 meter, the improvement wherein the yarn tube has at least one yarn encircling beaded segment with a radially inwardly protruding edge which reduces the inner diameter of the tube by at least 5% up to 50% of said nominal diameter.

19 Claims, 8 Drawing Figures

TEXTURING MACHINE

BACKGROUND OF THE INVENTION

The present invention is concerned with an improvement in a texturing machine, in particular a texturing or crimping machine for air-jet texturing or false twist texturing of continuous synthetic fibers, in which the running thread in its bulked or crimped form is subjected to a heat treatment inside of a straight diameter tube through which the thread is conducted, heat being applied from outside the tube.

Crimping or texturing processes are well known in the synthetic fiber art, for example in the form of a durable false twist crimping or an air-jet texturing. In a false twist crimping, the thread is first conducted through the false twist crimping process, including a heating and cooling stage to impart permanent deformations to the yarn in its twisted state and to heat-set the untwisted and already crimped and bulky yarn under a relatively low thread tension. The individual filaments of the thread are already crimped before entering this second heating stage, and it is one object of this invention to improve this second heating stage.

In air-jet crimping, for example according to the German patent specification DE-OS No. 27 49 867, which corresponds to U.S. application, Ser. No. 958,644, filed Nov. 8, 1978, now U.S. Pat. No. 4,338,776 the thread is first conducted through an air jet nozzle in which the individual filaments are laid into bows, loops, curls and the like. Immediately after a stabilizing zone, in which a mechanical stretching and stabilization of the thread occurs, the thread is conducted through a heating device, again under relatively low tension.

The heating tubes in those machines have to provide a sufficient dwelling time to the yarn running with a linear velocity of more than 150 m/min. The tubes there have a length of more than 1 m and may have even 1.5 m and up to 2.5 m.

It was found in these crimping or texturing processes, especially in the case of the heat treatment of air-jet textured, fine synthetic yarns or threads of, for example, less than about 500 denier and especially 150 denier, considerable thread tensions and sudden thread tension jumps occur due to thread or filament adhesion to the inner wall of the tube. These abnormally high thread tensions lead in every case to a reduced quality and, in the case of low filament deniers, also lead to filament breakage. The thread tension fluctuations are quite noticeable in finished products because they cause a difference in dyeing.

Attempts have been made in practice to avoid these disadvantages of frictional contact between the tube and thread by using tubes of greater diameter, i.e. for example, more than 6 mm. However, this increase in tube size has not produced the desired result. Furthermore, heat losses become higher and heat transfer to the threads becomes considerably worse as the size of the tube increases.

SUMMARY OF THE INVENTION

It is an object of the present invention to substantially reduce or eliminate sudden changes in tension and filament breakage in an elongated heat treatment zone of a conventional crimping or texturing process, especially when working with a synthetic yarn composed of relatively fine denier filaments undergoing an air-jet texturing and a subsequent heat setting while passing axially through an elongated heater tube which is heated from outside by indirect heat exchange, e.g. using a suitable heat exchange fluid in order to transfer heat through the walls of the heater tube to the yarn conducted axially therethrough.

In accordance with the invention, it has been found that this object is achieved with a substantial improvement in the texturing process by using a heater tube having a nominal inner diameter of more than 10 times the diameter of the treated yarn over most of its length but containing at least one yarn encircling, beaded segment with a radially inwardly protruding edge which reduces said inner diameter of the tube by about 5 to 30% of said nominal inner diameter. This inwardly positioned edge may be insulated against heat conduction, e.g. by choice of the material of construction or by a passive or positive cooling means such as an insulated air space or injection of cooling water. The inner diameter of the heater tube may be constricted by as much as 50% through use of one and preferably a plurality of beaded segments. The nominal inner diameter of the tube is preferably not more than 6 mm in order to avoid unnecessary heat losses and to further heat transfer from the wall to the yarn.

In most cases, the best results are achieved by using at least two beaded segments, one in the entry zone or section of the heater tube and one in its exit zone or section. Additional beaded segments may also be used to ensure a positive guidance to the running thread or yarn, and these beaded segments can be in the form of a closed ring or an open-ended spiral, preferably extending not more than 1.0% over the length of the tube for each spiral and preferably less than 2.5% of the length of the tube with respect to the total of all of the individual segments. In any case, the beaded segments should be designed long enough in the direction of the tube length to avoid sharp edges dammaging the yarn, but such as to minimize the contact length between yarn and those segments.

THE DRAWINGS

Figure 2:
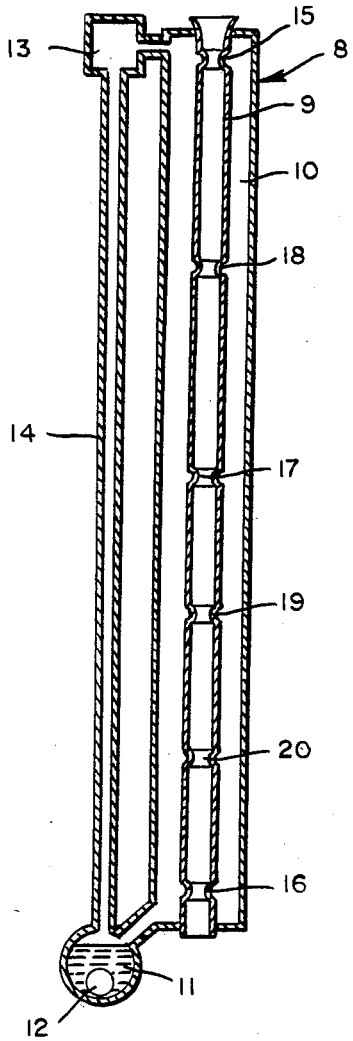
FIG. 2 is a partial cross-sectional view of a heater with a small diameter heating tube containing beaded segments according to one embodiment of the invention.
Figure 3A:
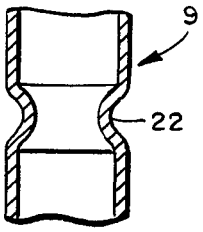
Figure 3B:
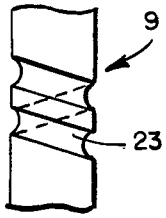
Figure 3C:
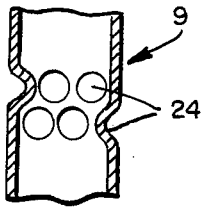
Figure 4:
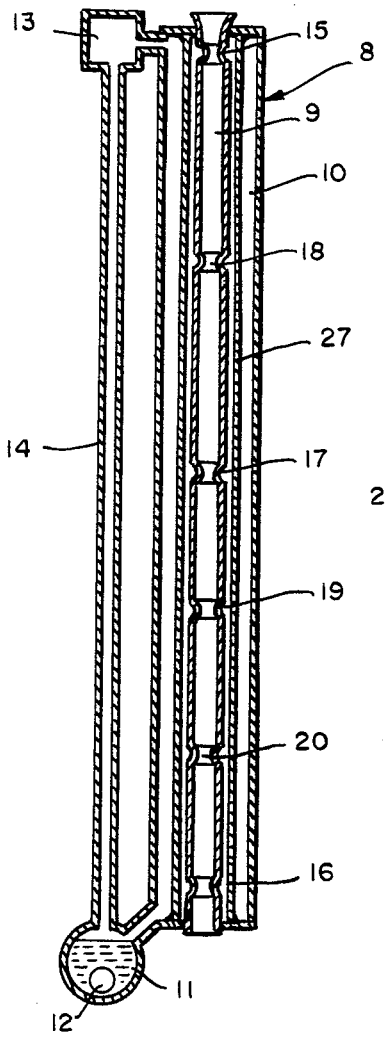

FIGS. 3*a*, 3*b*, 3*c*, 3*d* and 3*e* are detailed cross-sectional views of a number of different embodiments of the beaded segments of the heating tube of the invention; and FIG. 4 is a cross-sectional view of a heater modified in certain structural aspects with respect to FIG. 2 but having the same heating tube according to the invention.

The invention is further described in detail hereinafter with reference to the particular embodiments of the drawings but is not limited to these embodiments.

DETAILED DESCRIPTION OF THE INVENTION

Figure 1:
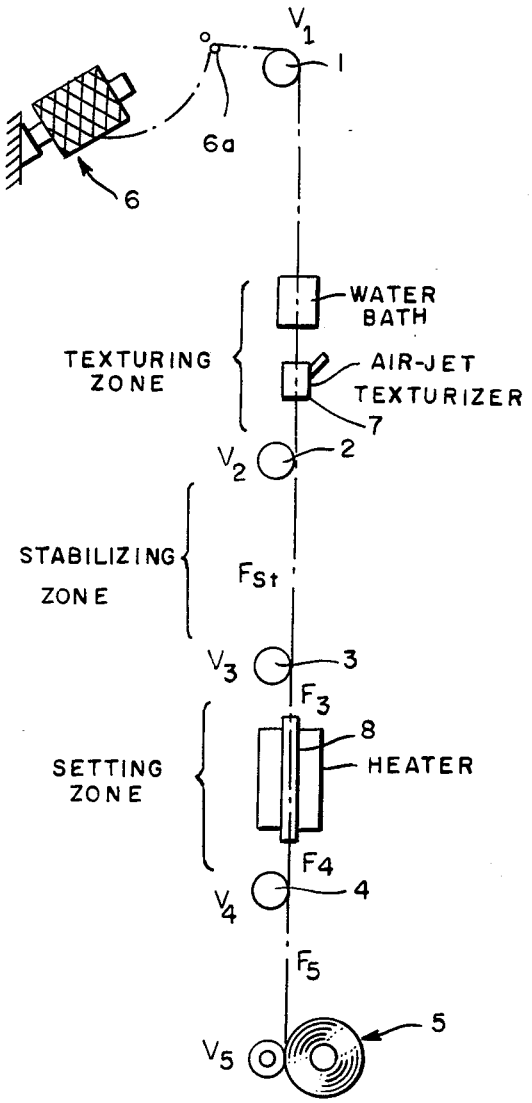
FIG. 1 is a schematic illustration of an air-jet texturing process and apparatus with heating of the textured thread in an elongated heater tube.

An air-jet texturing process and suitable apparatus for this particular process are schematically shown by way of example in FIG. 1, and a more detailed description is given in my copending U.S. application Ser. No. 958,644, filed Nov. 8, 1978, the disclosure of which is incorporated herein by reference as fully as if set forth in its entirety. In general, this particular process is one in which an unheated air jet is used to texturize or bulk crimp a multifilament synthetic yarn in a first stage or zone, then mechanically pulling out so-called "metastable loops" without heating and without stretching or deforming the yarn filaments in a heat-free stabilizing stage or zone, next shrinking and heat setting the yarn in a setting stage or zone at an elevated temperature, e.g. about 150°-245° C., and finally winding the yarn onto a take-up spool or bobbin at a predetermined yarn tension.

These various stages or zones can be carried out with the apparatus of FIG. 1 under controlled thread speeds and tensions, beginning with an uncrimped feed yarn, continuously treating and finally winding up the textured yarn in a single high speed operation. The present invention is particularly directed to the final heat setting stage or zone of a crimping or texturing process and is readily incorporated into the setting stage or zone of said copending U.S. application, Ser. No. 958,644.

The yarn delivery means such as godets 1, 2, 3, and 4, as shown in FIG. 1, are adapted to feed or conduct the yarn into and through each of the texturing, stabilizing and setting zones.

The individual velocities of the delivery means are indicated by the respective symbols $V_1$, $V_2$, $V_3$ and $V_4$, and the tensions on the yarn are indicated by the symbols $F_{St}$ (stabilizing zone), and $F_3$ and $F_4$ (on either side of heater 8 in the setting zone). The final take-up spool or winding bobbin 5 winds the finished yarn package at a velocity $V_5$ and under a predetermined tension $F_5$. The initial multifilament yarn is provided from a run-off or feed bobbin 6, passing through the schematically indicated guide or tensioning means 6a positioned just before the first yarn delivery means 1.

The air-jet texturing device 7 receives yarn at an overfeed rate $V_1$ greater than $V_2$ while $V_3$ is sufficiently higher than $V_2$ to draw out metastable loops without causing any elastic or plastic deformation of the individual filaments. The yarn velocity $V_4$ is slightly less than $V_3$ and tends to produce different tensions $F_3$ and $F_4$ before and after heater 8 due to the shrinkage and setting of the yarn in this stage.

The texturing device 7 of FIG. 1 consists essentially of an air-jet nozzle, especially a nozzle wherein the yarn or thread passes through a texturing chamber in which the expansion of an air jet conducted concentrically to the thread causes the individual filaments to be interlaced and tangled, i.e. thrown into bows, arcs, loops and the like which then project beyond the normal circumference of the multifilament thread to yield a certain bulking effect. Such texturing nozzles are shown, for example, in the German published application DE-AS No. 2,362,326. Other forms of execution of texturing nozzles are found, for example, in U.S. Pat. Nos. 2,874,444, 2,874,445, 2,982,000, 3,577,614, 2,994,938, 3,545,057, 3,017,737, 2,852,906, 3,969,799, 3,881,231, 3,881,232, 3,863,309 and 3,835,510.

It should also be mentioned, however, that a heater with a heating tube according to the invention is also capable of being used in other texturing machines, for example, in a false twist crimping machine as the second heater thereof which is often used for a so-called "post-heat-treating" of the already crimped yarn. For example, reference can be made to patents such as the German patent specification DE-OS No. 25 30 125, where there is shown and described a false twist crimping machine with a second heater.

As will be apparent from FIG. 2, the heater of the present invention includes the special tube 9 which penetrates the outer casing 10 at either end. The casing 10, which acts as a heat exchanger around tube 9, is in fluid connection with a tubular liquid container 11. This tube 11 extends as a sump or manifold along the length of part of or the entire texturing machine, and a plurality of casings 10 are connected to this single manifold tube 11, i.e. one for each operating position. The tube 11 contains an electric resistance heater 12 in order to vaporize a suitable heat exchange liquid, for example water or diphenyl (sold under trademarks such as Dowtherm and Diphyl) which partially fills the tube. The liquid vapors rise into the casing 10 and condense on the outer circumferential surface of the tube 9, so that the heat of condensation is given off to the tube 9. The condensed liquid flows back into the tube 11 again, while the vapors pass back over equalizing vessel 13 and reflux tube 14 into the manifold tube 11.

According to the embodiment of FIG. 4, the heating tube 9 is surrounded by an inner tubular casing 16, which is sealed off with a gastight fitting at either end with the outer casing 10. The condensation of the heat exchange medium takes place in this embodiment of the heating arrangement not on the tube 9 but on the inner tubular casing 16. This arrangement makes it possible to change the heating tube 9 or to take it out of the casing 10 for cleaning, without opening the closed heat exchange system and without interrupting the heating process at other working positions of the texturing machine.

In one example according to the invention, the tube 9 as represented in FIG. 2 was made with a length of 1.50 meters, an inside diameter of 5 mm and a wall thickness of 0.25 mm. At a distance of 80 mm from entry and exit in each case, the tube 9 was constructed with a circular beaded segment 15 and 16, respectively, formed by smoothly pressing in and constricting the tube wall, i.e. to form a bulge- or bead-like ring which extends radially inwardly from the inner circumference of the normal tube wall. Since the wall of the tube 9 is desirably constructed of a good heat-conducting metal, e.g. copper, stainless steel or the like, it is relatively easy to shape each beaded segment by using a suitable forming die which also ensures a uniform inner diameter of the beaded segments as well as the tube itself.

In addition, another beaded segment 17 was provided in the middle of tube 9 of the example given by FIG. 2. It also proved advantageous to further provide in the upper half of the tube 9 another circular beaded segment 18 positioned about halfway between the entry bead 15 and the center bead 17. It was also found to be preferable to locate yet another two beaded segments 19 and 20 spaced equidistantly from each other and from the center bead 17 and exit bead 16 in the lower half of the tube 9.

As shown by the enlarged cross sectional views of each of the FIGS. 3a to 3e, respectively, the beaded segments of the tube 9 can be constructed in a number of different ways.

For example, the beaded segment 22 shown in FIG. 3a can be formed as indicated with reference to FIG. 2, i.e. the tube wall 21 is pressed in or "necked down" over its circumference in such a way as to form a radially inwardly projecting bead or bulge. These are preferably annular or circular, i.e. closed in themselves, with a centerline of the bead on a plane perpendicular to the longitudinal axis of the tube 9.

It is also possible, however, as shown in FIG. 3*b*, to provide an open-ended beaded segment 23 which is not a closed ring but a helical deformation in the tube wall which extends spirally over a short interval of the tube length.

Equally good results were achieved as indicated in FIG. 3*c* with the use of several bump-like deformations distributed in a series of small beads or bulges 24 over the circumference of the tube 9. These small beads 24 when taken together around the circumference of the tube form an equivalent circular or ring-like beaded segment.

Figure 3D:
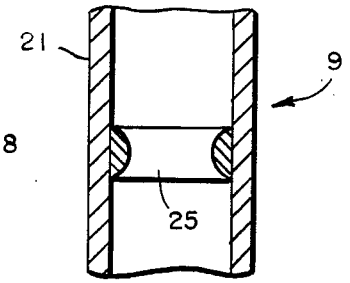
Figure 3E:
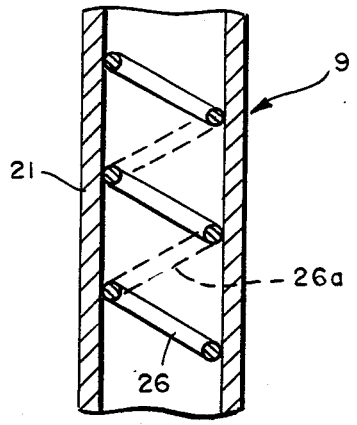

Instead of deforming the tube wall, it is possible to insert separate beads, annular rings or spirally coiled members into the tube 9, again constricting the tube at selected positions over its length in comparison to its normal or nominal inner diameter. FIG. 3*d* illustrates, for example, a ring member 25 as an insert which has been press-fitted into the tube 9. According to FIG. 3*e*, a helical metal winding 26 is positioned on the inside wall of the tube 9. The omitted portions of this helical winding or coil are indicated in broken lines 26*a*.

In the embodiment of the invention illustrated by FIG. 2, using any of the various beaded segments of FIGS. 3*a* to 3*e*, good results have been obtained by constricting the nominal inner diameter of the tube 9 which had a diameter of 5 mm, by about 20%, using a bead in each case with a rounding radius r=0.5 mm and an extension in the direction of the tube of 1 mm. By means of these constricted portions of the tube, which as a rule should not exceed more than about 1% of the total length of the tube, one can achieve a number of advantages which greatly improve the texturing operation.

For example, with constrictions at the entry and exit ends of the heating tube 9, it has been possible to achieve a more uniform temperature with an even heat conduction over the length of the tube. Moreover, the energy losses are substantially lower.

A particular advantage of the invention resides in the improvement of the gentle handling of the thread during a sensitive heat treating step. Thus, using the very simple measure of providing at least one beaded segment at or near the entry end of the heating tube, preferably with at least one other beaded segment at or near the exit end of the heating tube, it has been possible to set the thread tension at a very low level in the running thread, which is already textured or crimped. Also, this thread tension can be maintained in a much more even and uniform manner over the length of the heating tube.

Only in this way has it been possible to produce critically sensitive threads of low denier, for example with a yarn size of 78 dtex, without the occurrence of frequent filament breakage. Moreover, in the yarn size range of about 55 to 500 dtex (50 to 500 denier), a very appreciable improvement in quality has been achieved. Thus, thread tension fluctuations are eliminated or substantially reduced so as to avoid noticeable differences in the crimping or texturing effect over the length of the thread. The uniformity of dyeing is also substantially improved. It has turned out that the frequently observed damages caused by the previously employed smooth heating tubes, seriously affecting the crimping and dyeing uniformity on only one side of the thread or yarn, are completely avoided by the measures taken to improve heating tube performance in accordance with the present invention.

The constrictions or beaded segments incorporated into the heating tubes of the invention tend to come in contact with the running thread or yarn more frequently, and in fact, serve as radially limiting guide means. Surprisingly, this contact is not harmful due to the limited amount of curved bead surface at its innermost projection.

The embodiment of FIG. 4 provides a greater space and, therefore, less heat transfer in the zone or area of the beaded segments, i.e. where a greater annular space is created between the inner tubular casing 16 and the heater tube 9. This may contribute to the positive results of the invention and avoid damages by contact of the yarns to the beaded segments.

It will be appreciated that variations in the structure and arrangement of the individual parts of the heating tube and the rest of the heater can be carried out by one skilled in this art, e.g. using different but equivalent materials and adapting the precise size and shape of the heater and heating tube to best fit a given texturing operation. These and other changes are permissible within the spirit and scope of the claims appended hereto.

I claim:

1. In a heating tube for heat-setting a texturized yarn conducted in a linear path substantially along the tube axis, including means to heat said tube from its outer circumference, the improvement which comprises:

an elongted heating tube having a nominal inner diameter which is more than ten times the diameter of the texturized yarn and having a length of more than one meter, but containing a plurality of yarn encircling beaded segments with rounded inwardly protruding edges, at least one beaded segment being arranged in the entry section and in the exit section of the tube and a plurality of additional beaded segments being distributed along the length of the heated tube between the entry and exit sections, each of said beaded segments being formed by a smooth, ring-shaped deformation of the wall of the heating tube and each of said beaded segments reducing the inner diameter of the heating tube by at least 5% up to about 50% of said nominal diameter while occupying not more than 1% of the total length of the heating tube, measured from its entry end to its exit end, and the total of all beaded segments occupying not more than 2.5% of said total length of the heating tube.

2. The improvement as claimed in claim 1 wherein said nominal inner diameter is less than 6 millimeters.

3. The improvement as claimed in claim 2 wherein said tube has a length of at least 1 meter.

4. The improvement as claimed in claim 1 wherein each beaded segment occupies not more of the length of the heating tube than the dimension of the nominal inner diameter of the tube.

5. The improvement as claimed in claim 1 wherein each beaded segment reduces the nominal inner diameter of the heating tube by about 10 to 30%.

6. The improvement as claimed in claim 1 wherein at least four additional beaded segments are positioned between the entry and exit sections of the tube.

7. The improvement as claimed in claim 1 wherein each beaded segment reduces said inner diameter of the tube by about 10 to 30%.

8. The improvement as claimed in claim 1 wherein each beaded segment is formed by at least two adjacent circumferential rows of a plurality of bulges pressed into the wall of the heating tube, said rows being situated on adjacent planes perpendicular to the longitudinal axis of the tube and said bulges being arranged in a staggered formation from row to row.

9. The improvement as claimed in claim 1 wherein each beaded segment is formed by a separate yarn encircling, bead insert member which is fitted onto the inner wall of said heating tube and which has a rounded inwardly protruding edge.

10. The improvement as claimed in claim 9 wherein said bead insert member reduces the nominal diameter of the heating tube by about 10 to 30%.

11. The improvement as claimed in claim 9 wherein said bead insert member is formed by a curved body of circular cross section, the outer diameter of the insert corresponding to the inner diameter of the tube and the inner diameter of the insert forming the rounded inwardly protruding edge.

12. The improvement as claimed in claim 11 wherein the insert member is curved into a closed ring shape.

13. The improvement as claimed in claim 11 wherein the insert member is curved into an open-ended spiral shape.

14. The improvement as claimed in claim 11 wherein said bead insert member reduces the nominal inner diameter of the heating tube by about 10 to 30%.

15. The improvement as claimed in claim 1 wherein said means to heat said tube from its outer circumference includes an inner tubular casing with an inner diameter which matches the outer diameter of the heating tube for heat transfer from said casing through the wall of the heating tube, and a hollow chamber surrounding both the heating tube and said inner tubular casing and being in fluid connection with a sump containing a fluid heat exchange medium supplied to the hollow chamber as a vapor capable of condensing on the outer wall surfaces of said inner tubular casing with means to return the condensed liquid to said sump.

16. The improvement as claimed in claim 15 wherein the beaded segments of said heating tube form with the inner wall surface of said inner tubular casing an annular heat-insulating gap space.

17. The improvement as claimed in claim 1 wherein each beaded segment is formed by a smooth necking down deformation of the wall of the heating tube to provide a rounded inwardly protruding edge.

18. The improvement as claimed in claim 17 wherein said beaded segment formed by the tube wall has an open-ended spiral shape.

19. The improvement as claimed in claim 17 wherein said beaded segment formed by the tube wall has a closed ring shape.

* * * * *